US005368514A

United States Patent [19]

Glickman et al.

[11] Patent Number: 5,368,514

[45] Date of Patent: Nov. 29, 1994

[54] VEHICLE TRACK SUPPORT FOR CONSTRUCTION TOY SYSTEM

[75] Inventors: Joel I. Glickman, Huntingdon Valley; Robert E. Simon, Jr., Southampton, both of Pa.

[73] Assignee: Connector Set Limited Partnership, Hatfield, Pa.

[21] Appl. No.: 195,734

[22] Filed: Feb. 14, 1994

Related U.S. Application Data

[63] Continuation-in-part of Ser. No. 101,422, Aug. 3, 1993, and a continuation-in-part of Ser. No. 19,066, Feb. 18, 1993, and a continuation-in-part of Ser. No. 759,400, Sep. 13, 1991, Pat. No. 5,238,438.

[51] Int. Cl.[5] ..... A63H 18/00

[52] U.S. Cl. ..... 446/122; 446/120; 446/126

[58] Field of Search ..... 446/85, 93, 96, 108, 446/111, 120, 122, 444, 445, 446, 489, 124, 126; 104/140, DIG. 1; 52/245

[56] References Cited

U.S. PATENT DOCUMENTS

| | | | |
|---|---|---|---|
| 2,782,730 | 2/1957 | Frank | 446/446 X |
| 3,541,724 | 11/1970 | Einfalt | 101/140 X |
| 3,698,130 | 10/1972 | Usami | 446/445 |
| 3,699,711 | 10/1972 | Coffey, Sr. | 446/445 |
| 4,571,204 | 2/1986 | Wang | 446/445 X |
| 5,061,219 | 10/1991 | Glickman . | |
| 5,118,320 | 6/1992 | Miller | 446/445 X |
| 5,137,486 | 8/1992 | Glickman . | |
| 5,199,919 | 4/1993 | Glickman . | |

*Primary Examiner*—Sam Rimell

*Attorney, Agent, or Firm*—Schweitzer Cornman & Gross

[57] ABSTRACT

A construction toy system is disclosed for the assembly of a guide track structure for a wheeled vehicle. Basic structural components, comprising rod-like struts and molded plastic connector elements adapted for snap-together attachment to the strut elements, enable support structures to be assembled. One or more guide track elements is provided, preferably in the form of a continuous, slotted flexible tube, typically formed by extrusion of plastic material. Special track-mounting connector elements are formed with track-mounting lugs which extend through the slotted side of the tubular track element to provide internal support. Track-mounting lugs are positioned at spaced points throughout the structure, providing spaced support for the track element. The flexible track element is self-supporting between mounting lugs, and conforms readily and smoothly to vertical and horizontal contours of the structure. An intermediate clip-like support device, which attaches to but does not form part of the structural framework, provides additional and optimized support of the flexible track between fixed support points, where such additional support is necessary or desirable. The clip-like support may be slidably adjusted along a longitudinal structural member underlying the normal path of the rail.

6 Claims, 6 Drawing Sheets

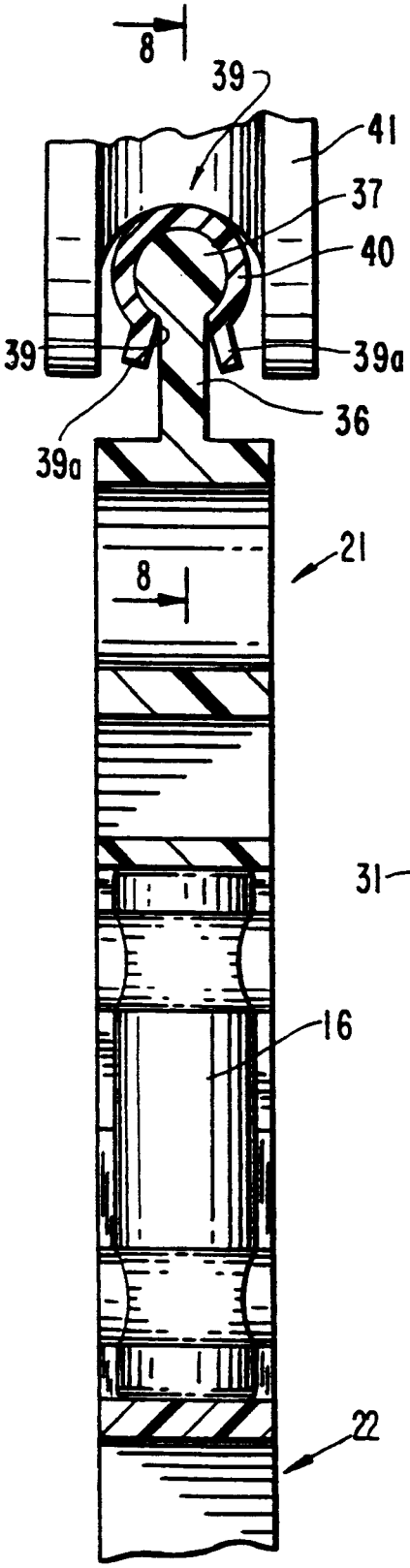
FIG. 7
FIG. 8
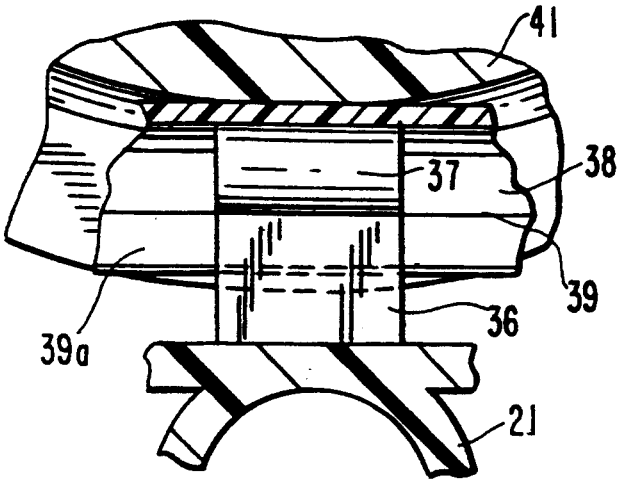
FIG. 9
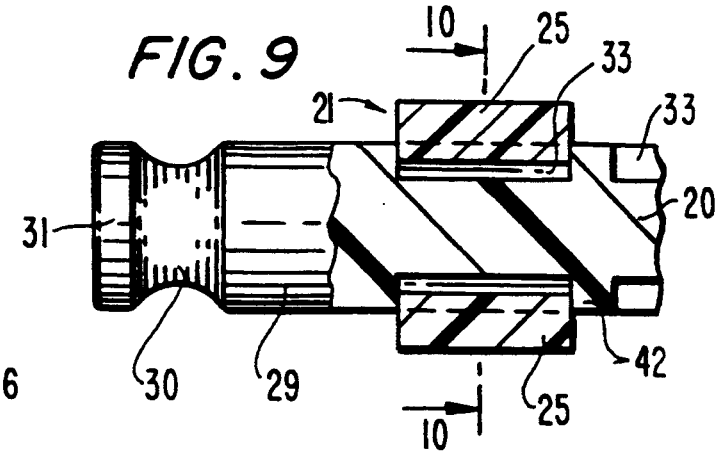
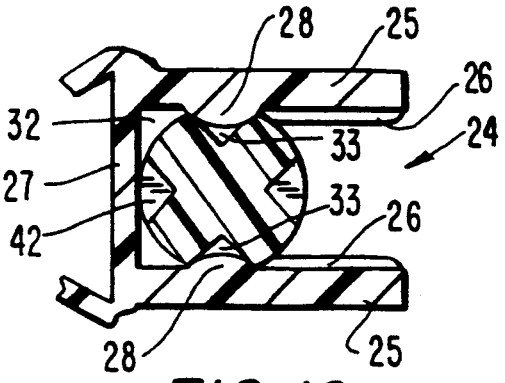
FIG. 10

VEHICLE TRACK SUPPORT FOR CONSTRUCTION TOY SYSTEM

RELATED APPLICATIONS

This application is a continuation-in-part of copending application Ser. No. 101,422, filed Aug. 3, 1993, now pending, of application Ser. No. 019,066, filed Feb. 18, 1993, now pending, and of application Ser. No. 759,400, filed Sep. 13, 1991, now U.S. Pat. No. 5,238,438. The application is also closely related to the earlier Glickman U.S. Pat. No. 5,061,219, granted Oct. 29, 1991, U.S. Pat. No. 5,199,919, granted Apr. 6, 1993, and U.S. Pat. No. 5,137,486, granted Aug. 11, 1992.

BACKGROUND AND SUMMARY OF THE INVENTION

This invention is based upon a novel construction toy system as described and claimed in the above mentioned pending applications and issued patents, all owned by Connector Set Limited Partnership. In general, the basic construction toy system is comprised of a novel strut and connector system in which connectors are provided with open-sided sockets for the lateral reception and substantially rigid retention of end portions of rod-like strut elements. The sockets of the connector elements are defined by spaced-apart gripping arms formed with axially extending grooves which engage and grip opposite sides of a strut adjacent its end to align and firmly hold the strut along a predefined axis. One or more locking elements project from the gripping arms partially into the socket area, and these are received in grooves formed on the socket area, and these are received in grooves formed on the ends of the struts, such that the struts, when engaged by the gripping arms, are locked against axial motion by cooperation between the projections and grooves. Desirably, the struts are provided with longitudinally extending opposed grooves designed for cooperation with the locking projections formed on the gripping arms of the connector elements. This arrangement enables the struts to be pressed crosswise into the gripping sockets, until the locking projections are snapped into the opposed longitudinal grooves, thus firmly locking the strut in a crosswise orientation in the connecting element.

The above described construction toy system enables large and complex three-dimensional structures to be assembled in virtually limitless variety. The present invention enables the incorporation, in a structure assembled using the described construction toy system, of a simplified track structure for the guided movement of a vehicle. To this end, the system incorporates specially modified connector elements which, in addition to forming part of an underlying structural framework, also mount and support guide rails forming a vehicle guide track. The system of the invention enables guide tracks to be designed with portions arranged in a straight line manner, and with other portions formed with horizontal curves and vertical contours. By way of example, a representative structure specifically illustrated herein is in the form of roller coaster, which easily illustrates the manner in which the invention can be employed.

To particular advantage, the track system of the invention utilizes, for the rail elements of the track structure, generally continuous lengths of modified flexible plastic tubing, which is slotted lengthwise. Special connector elements, provided for mounting and supporting the rail elements, are formed with integral mounting lugs, each including an upwardly projecting stem portion and an enlarged head portion. The rail elements can be assembled to their supports by applying the slotted side of the tubing over the mounting lugs, so that the interior of the tubular rail section is supported by the head portions of the mounting lugs, and the rail section is spaced above the connector element by the stem portion, which passes through the slotted sidewall of the rail. In a typical track structure, rail-supporting connector elements are spaced apart longitudinally, and the rail sections are self-supporting in the spaces between longitudinally adjacent connector elements.

One form of the rail-supporting connector is a modification of an otherwise standard connector element for the construction toy system, which is incorporated in the basic underlying structure and forms part of the structure. For purposes of this description, such a connector will sometimes be referred to as a structural connector. In addition, the system of the invention includes separate clip-like support devices, which attach to the basic underlying structure, but do not form part of the structural framework. The rail-supporting clips may be installed anywhere along the length of a strut element underlying the rail path, to support a section of rail which is adjacent thereto. The support clips may be slidably adjusted longitudinally along the rod-like strut elements so that the location of the support may be empirically optimized. In addition, the rod-like strut elements are, in most cases, rotationally adjustable in the structural framework, which facilitates shaping of the rail in horizontal and vertical curved areas.

For a more complete understanding of the above and other features and advantages of the invention, reference should be made to the following detailed description of a preferred embodiment of the invention and to the accompanying drawings.

DESCRIPTION OF THE DRAWINGS

FIG. 7 is an enlarged fragmentary cross sectional view as taken generally on line 7—7 of FIG. 2.

FIG. 8 is an enlarged fragmentary cross sectional view as taken generally on line 8—8 of FIG. 7.

FIG. 9 is an enlarged fragmentary cross sectional view as taken generally on line 9—9 of FIG. 2.

FIG. 10 is a fragmentary cross sectional view as taken generally on line 10—10 of FIG. 10.

DESCRIPTION OF PREFERRED EMBODIMENTS

Figure 1:
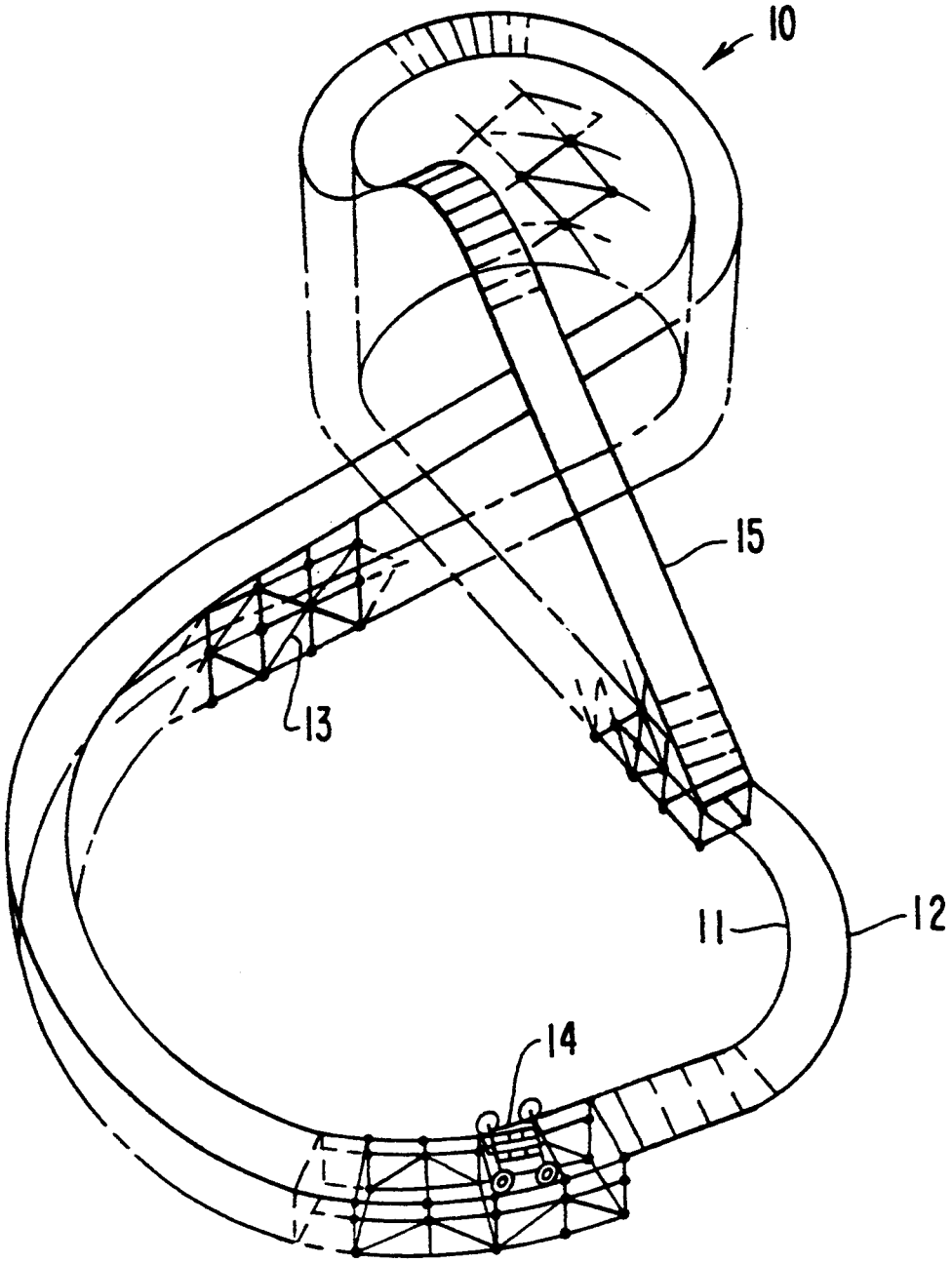
FIG. 1 is a schematic perspective illustration of a simple roller coaster structure constructed in accordance with the invention.

Referring now to the drawing, the reference numeral 10 (FIG. 1) represents generally a typical structure employing the features of the invention. In the illustrated instance, the structure 10 is a roller coaster comprised of spaced-apart rails 11, 12 mounted on a skeletal structure 13 comprised of rod-like struts and connector elements, preferably according to the principles and disclosures of the before mentioned Glickman United States patents. The rails 11, 12 are spaced-apart uniformly over their entire length, forming a two-rail guide track for one or more wheeled vehicles 14. In a structure such as shown in FIG. 1, a motorized or manual lift device (not shown) desirably is provided for carrying the vehicle 14 up an inclined portion 15 of the structure. When the vehicle reaches the top of the incline, it is released and returns by gravity to the bottom of the incline.

Figure 2:
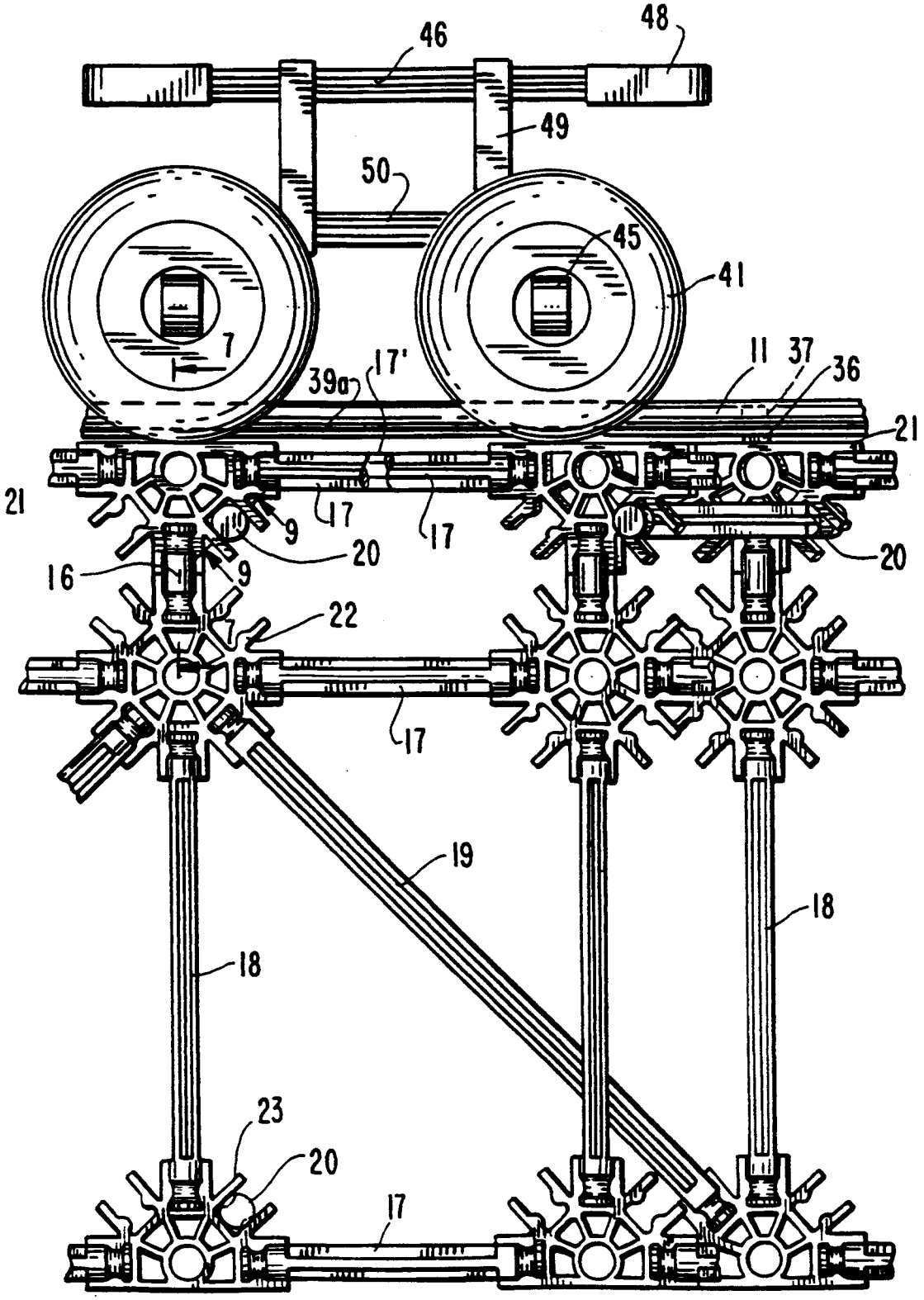
FIG. 2 is an enlarged, fragmentary view showing a section of the structure of FIG. 1.
Figure 3:
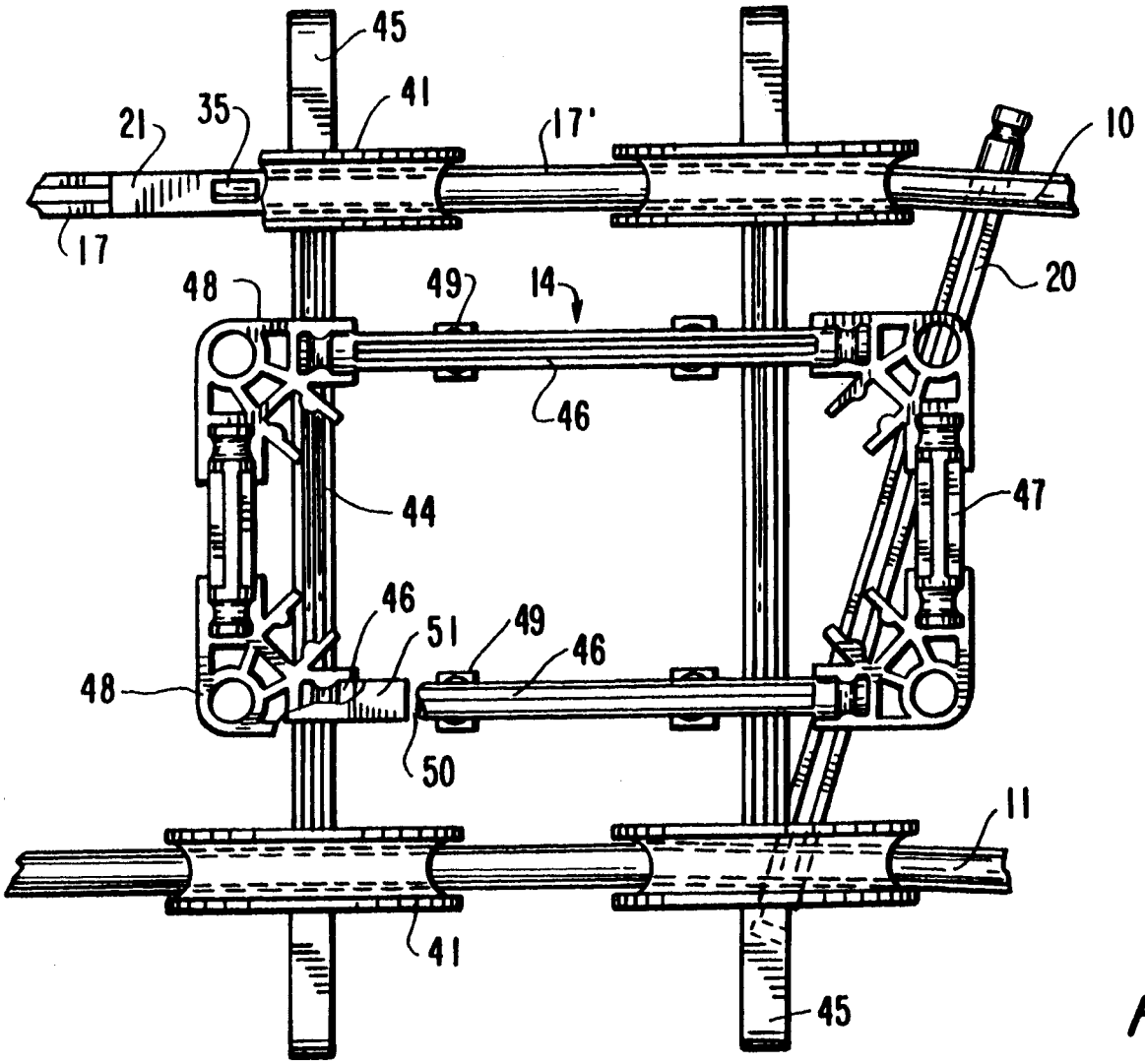
FIG. 3 is a top plan view of the structural segment of FIG. 2.

With reference to FIGS. 2 and 3, a rail-supporting structure of suitable configuration may be assembled utilizing a plurality of struts 16–19 and transversely disposed spacing struts 20, joined with connector elements 21–23. Pursuant to principles of my before mentioned patents, the connector elements are preferably formed of molded plastic and are provided with a plurality of strut-engaging sockets 24 (FIG. 10). The sockets 24 are comprised of spaced-apart gripping arms 25 formed with axially extending grooves 26. The sockets 24 are open at one end and closed at the other by an end wall 27. Locking projections 28, integral with the gripping arms 25, project slightly into the socket space forming a constriction.

As shown in FIG. 9, the several strut elements are provided at each end with a configuration complementary to the sockets 24. In particular, in a preferred form the strut end includes a cylindrical section 29, an annular grooved portion 30, and an end flange 31. The end flanges 31 are adapted to be closely received in an end chamber 32 in the connector socket, formed between the end wall 27 and the locking projections 28. The projections 28 are designed to closely conform to the annular groove 30 in the strut, and the cylindrical portions 29 of the struts are adapted to be received in and gripped by the axially grooved portions 26 of the gripping arms 25. Normal attachment of a strut to a connecting element involves a lateral snap-in assembly in which the strut end is forced laterally into an open side of the socket 24, with the gripping arms 25 temporarily flexing outward sufficiently to enable the cylindrical portions 29 of the strut to enter into the grooved portions 26. The strut is then firmly gripped and positioned in the socket.

As shown in FIG. 10, a strut can also be inserted into the socket in a crosswise orientation. To this end, central portions of the strut elements are formed with opposed grooves 33, running lengthwise along the struts. The positioning of the locking projections 28, in relation to the end wall 27 of the sockets, is such that, when a crosswise oriented strut is pressed into the open end of a socket 24, it can be pressed deep enough into the socket that the locking projections 28 snap into the longitudinal grooves 33, locking the strut firmly in its crosswise orientation.

As is reflected in the above mentioned patents, the connector elements can be provided in a variety of configurations, with multiple strut-receiving sockets radiating in a single plane, or in multiple planes, to accommodate a wide variety of structural possibilities.

In the specific structure shown in the drawings, which is illustrative and not in any way limiting of the multitude of possibilities, a structural base is formed by a plurality of flat-sided base connectors 23 joined by horizontal, longitudinally extending struts 17. In general, it is desired that the connector elements 23 be arranged in transversely opposed pairs and, as shown in FIG. 3, these may be joined by transverse spacing struts 20 received crosswise in the connector elements. In the illustrated arrangement, an elevated structure is formed using vertical struts 18, which extend from the base connectors 23 to intermediate connector elements 22. Longitudinally adjacent ones of the intermediate connectors 22 are joined by horizontal struts 17 of the same length as directly below.

Figure 4:
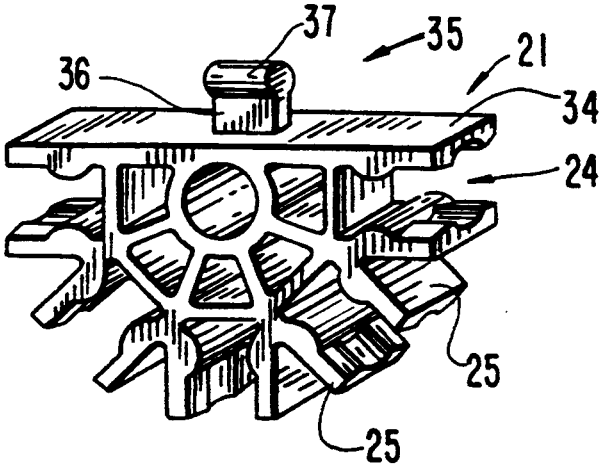
FIG. 4 is a perspective illustration of one preferred form of rail-mounting connector element according to the invention.

In the arrangement illustrated in FIG. 2, short struts 16 join the intermediate connector 22 with upper, rail-supporting structural connectors 21 incorporating features of the present invention. The connectors 21 are, in general, similar to the flat-sided base connectors 23. However, as shown in FIGS. 4 and 7, a rail-mounting lug 35 projects upward from the flat sidewall 34 of the connector. The lug 35 desirably is integral with the molded connector element 21 and is comprised of an upwardly projecting relatively flat, thin stem portion 36 and an enlarged head portion 37, which typically will be of cylindrical cross section. The rail-mounting lug 35 preferably is of relatively short length (measured horizontally in FIG. 4) in comparison with the overall length of the flat sidewall 34.

Figure 6:
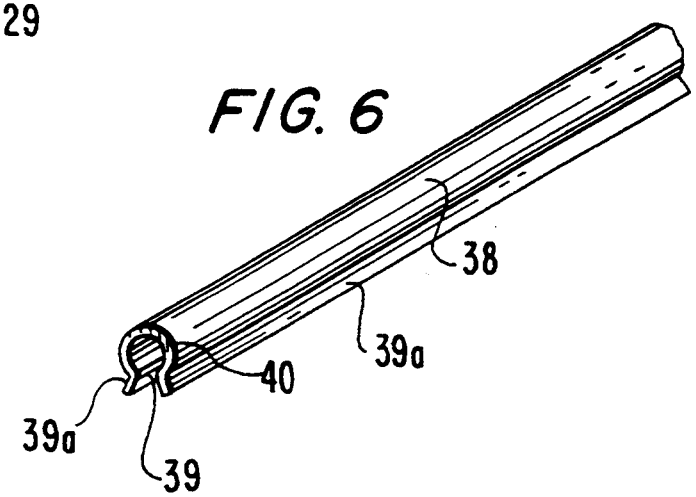
FIG. 6 is a perspective view of a section of rail utilized in the structure of the invention.

Cooperating with the rail-mounting lugs 35 are special rail elements 38, shown in FIG. 6 (and constituting the rail elements 11, 12 of FIG. 1). To particular advantage, the rail element 38 is an elongated section of extruded (or possibly molded) plastic tubing, which is formed with an open side 39 and continuous, divergent guide flanges **39*a* extending from its opposite edges. The tubing preferably is formed by extrusion of a flexible plastic material and, in an advantageous embodiment of the invention, has a hollow interior of approximately $\frac{1}{8}$ inch diameter and side walls 40 of approximately 1/32 inch in thickness. A suitable throat width for the slot-like opening 39** is approximately 0.06 inch.

In the illustrated form of the invention, the rail-mounting lugs 35 are sized and shaped to be complementary with the rail sections 38. To this end, the cylindrical head portions 37 of the mounting lugs of approximately $\frac{1}{8}$ inch diameter, to be received snugly within the $\frac{1}{8}$ inch internal opening of the tubing. The stem portions 37 may have a thickness of, for example, 0.063 inch, barely larger than the nominal width of the slot opening 39.

A complete track structure is made of a series of longitudinally joined connector elements 21, providing spaced-apart rail-mounting lugs 35. The rail sections 38 ideally are provided in more or less continuous lengths to provide for an uninterrupted rail over the entire length of the assembled structure. However, sections of rail can be joined in any suitable manner, or a single rail section may be joined end to end to form a closed loop. In many cases, it is sufficient merely to apply adjacent ends of a rail section to a common support lug 35. Alternatively, a thin rod-like connector plug (not shown)

may be inserted into the abutted ends of adjacent rail sections in order to provide a smooth connection and transition.

A preferred material for the tubular rail sections 38 is polypropylene, but other materials may be employed. The stiffness/flexibility of the rail sections is not critical. For some structures, relatively straight, relatively rigid rail sections may be preferred. In others, relatively flexible sections may be preferred, and some structures may desirably employ a mixture of both relatively rigid and relatively flexible sections, depending upon contours of the structure.

In a typical rail-supporting structure, there may be both vertical and horizontal contours. Horizontal curves may be provided by joining adjacent rail-supporting connectors 21 at opposite sides of the structure using struts of different lengths. For example, in FIG. 3, longitudinally adjacent connectors 21 at the bottom of the figure are joined by a strut 17 of one size, whereas the corresponding connectors 21 at the opposite side (top of the figure) are joined by a strut 17' of greater length. This causes the track structure to be curved slightly toward the bottom of the figure. A succession of such connections will cause the track structure to change directions significantly, as will be understood. Vertical contours may be imparted by employing vertical connecting struts of different size between the intermediate connectors 22 and the rail-supporting connectors 21. In the illustration of FIG. 2, for example, the rail-supporting connectors 21 are joined to the structure by struts 16 of minimum length. Over a succession of adjacent segments, the length of the connecting struts 16 may be progressively increased, to cause the track structure to be diverted upwardly. As is evident in FIG. 1, a structure of complex, compound contours may be easily assembled using struts of appropriate lengths to connect adjacent segments of the structure. By using relatively flexible rail sections 38, the contours of the tracks are smooth, with gradual transitions in changing from one direction to another.

Figure 5:
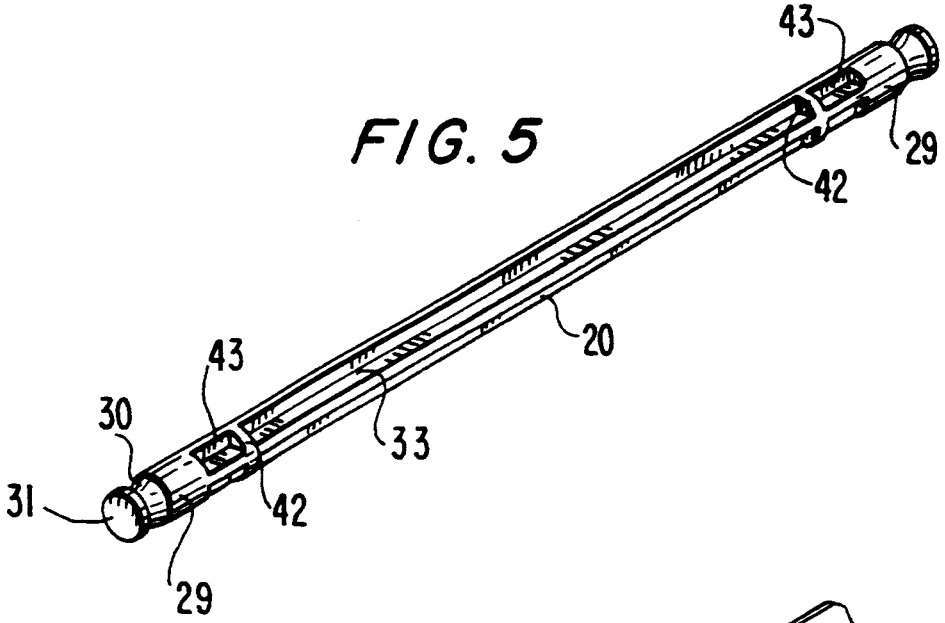
FIG. 5 is a perspective view of a preferred form of strut element employed in the construction of a track system, for maintaining uniform track spacing.

In any structure in which two or more parallel rails 10, 11 are employed to support a vehicle 14 having spaced-apart wheels 41, uniform horizontal spacing of the rails throughout is desirable. To this end, it is particularly advantageous to configure the transverse spacing struts 20 with spacing flanges 42 adjacent to but spaced from cylindrical end portions 29 of the spacing struts (see FIG. 5). The longitudinal grooves 33, which normally extend continuously from one end portion 29 to the other, are interrupted by the spacing flanges 42 to define locating sections 43. The length of the locating sections is approximately equal to, or slightly greater than the thickness of the connector elements 21, such that an opposed pair of gripping elements 25 can receive the strut 20 in a crosswise orientation within the limits of the spacing section 43. When the spacing strut 20 is thus joined with the connectors 21, the latter are accurately and uniformly spaced apart, so that the respective rails 11, 12 are maintained in relatively uniform horizontal spacing throughout the full extent of the track structure. The spacing struts 20 may of course be utilized in conjunction with any of the connector elements 22 or 23, at intermediate levels or at the base of the structure, as well as the rail-supporting elements at the top of the structure.

The track structure of the invention can be utilized with any wheeled vehicle having appropriately flanged wheels 41, as shown particularly in FIG. 3. In a typical assembly, pairs of the flanged wheels 41 are rotatably mounted on horizontal axle struts 44, using single socket connectors 45 at each end to retain the wheels on the struts. In the disclosed vehicle structure, which is merely illustrative, a vehicle body is made up of longitudinal struts 46 and transverse struts 47, joined at the corners by right angle connectors 48. Double-ended connectors 49 grip the longitudinal struts 46 and extend downward to engage longitudinal struts 50. Additional right angle connectors 51 are attached to the longitudinal struts 50 and to the axle struts 44 (see FIG. 3) to provide a rudimentary vehicle capable of rolling along the track structure.

Figure 11:
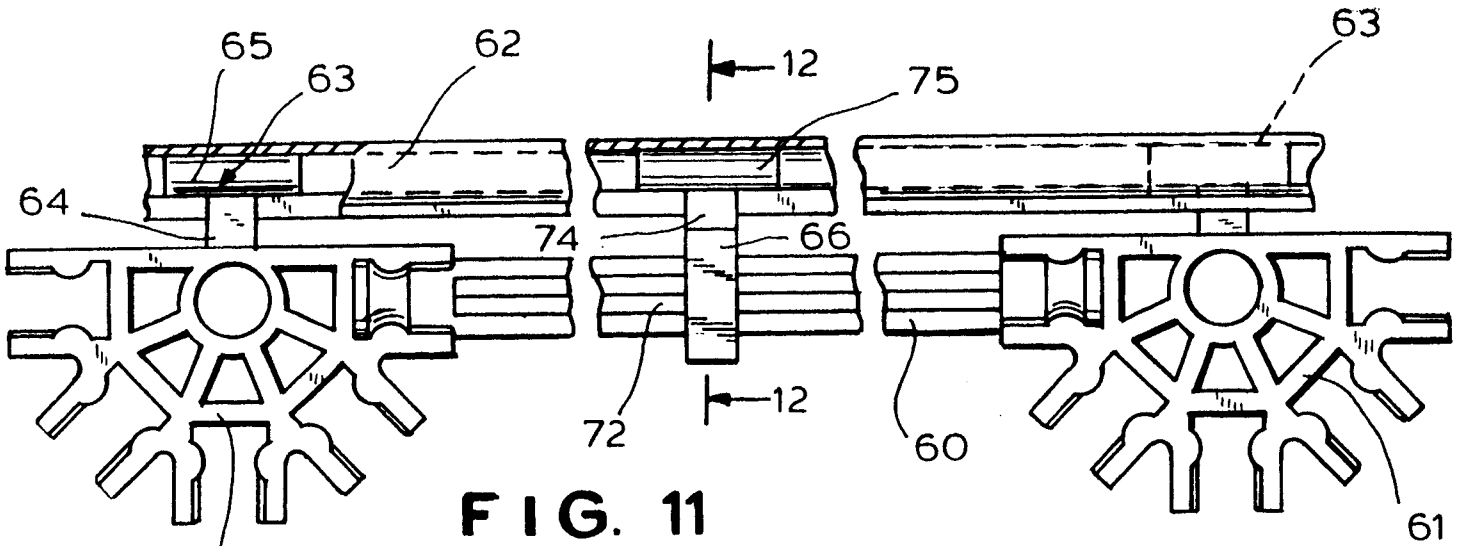
FIG. 11 is a fragmentary view, with parts broken away, of a section of structure and track, illustrating the use of a clip-like intermediate rail support element, which attaches to the underlying structure but does not form part of the structural framework.
Figure 12:
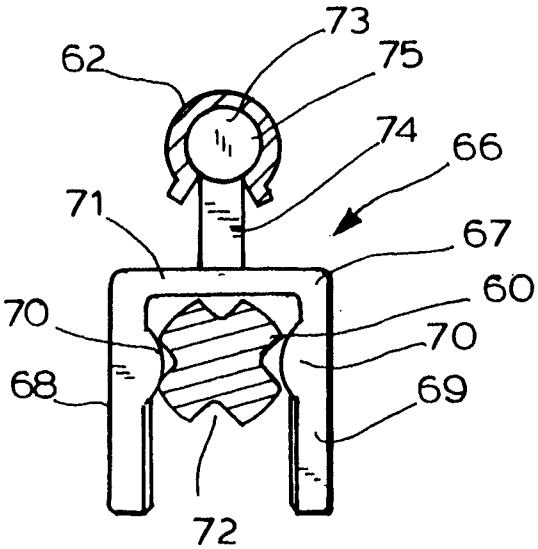
FIG. 12 is a cross sectional view as taken generally on line 12—12 of FIG. 11.

With reference to FIGS. 11 and 12, another preferred embodiment of the invention is illustrated. In the modified form of the invention, clip-like intermediate track supports can be attached to the structural framework at any of a wide variety of locations, as needed or desired, and readily adjusted to provide optimum support and contouring of the track. Thus, in the partial structure shown in FIGS. 11 and 12, a longitudinal strut element 60 is attached at each end to rail-supporting connector elements 61. The connector 61, together with the strut 60, form part of the structural framework supporting a rail 62, which may be an elongated section of plastic tubing of the type shown in FIG. 6.

Each of the structural connectors 61 is provided with a rail-supporting lug 63 comprising a thin, upwardly extending stem 64 and an enlarged, generally cylindrical head 65. The connector elements 61 illustrated in FIG. 11 correspond generally to the connector shown in FIG. 4 except that the head portions 65 of the rail-supporting lugs are of somewhat greater length to, among other things, facilitate the joining of rail sections end to end with a portion of the head 65 projecting into each of two butted-together rail sections.

To provide intermediate support for the rail section 62, between structural connectors 61, a clip-like support element 66 (see FIG. 12) can be used to great advantage. The support element 66 includes a body portion 67 comprising a pair of spaced-apart gripping arms 68, 69 which can be generally of the same type and configuration as the pairs of gripping arms incorporated in the structural connectors 21 and 61. In particular, each of the gripping arms 68, 69 is formed with a transverse locking projection 70 spaced a predetermined distance from the closed base end 71 of the clip body. The opposite end of the clip body is open and is adapted for the crosswise reception of the strut element 60.

As previously described, the strut elements incorporated into the structural framework, including the strut 60, are formed with longitudinal grooves 72 arranged such that, when the strut 60 is forced crosswise into the body of the clip-like support 66, the grooves 72 are lockingly engaged by the projections 70, in the manner shown in FIG. 12.

The clip-like support 66 is provided with a mounting lug 73 extending upwardly from the clip body 77, substantially in the same manner as the mounting lugs for the structural connectors 61. The lug 73 includes a flat upwardly projecting stem 74 integrally mounting a horizontally disposed cylindrical head portion 75.

In a typical structural framework for a vehicle track incorporated in the invention, adjacent structural connectors 61 are joined by a strut-like connector of predetermined length. If a section of rail 62, supported by mounting lugs 63 at spaced points, needs additional support or guidance, either because of the distance between mounting lugs 63 or because of the weight of the article to be supported on the rail, a clip-like support 66 can be installed on the strut 60, in the manner shown in FIG. 11, providing intermediate support for the rail element 62.

To particular advantage, when the clip-like support 66 is installed on the strut 60, the gripping arms 68, 69 engage the strut with sufficient force that the support 66 is retained in its installed position by friction of the gripping action of the arms 68, 69, so that the support will remain in the position in which it is installed. That position may be manually adjusted, of course, by simply manually sliding the clip longitudinally along the strut 60, to locate the clip-like support in the most desirable location. In addition, the support 60, which is engaged by the spaced-apart structural connector 61, is rotatable with respect thereto, although frictionally gripped by gripping sockets of the connectors. This enables the intermediate support to be adjusted slightly in a rotational manner, about the axis of the strut 60, so that the clip-like support 66 can automatically assume an appropriate position, even where the rail 62 has a horizontally curved configuration.

As will be readily appreciated, the system of the invention enables a complex, contoured track structure to be assembled. The illustrated structure employs a two-rail track structure for supporting a vehicle having two or more wheels. Monorail and multiple rail structures are also possible with the system of the invention. A feature of particular advantage is the utilization of strut and connector assemblies, providing for lateral snap-in assembly of the struts and connectors to enable complex skeletal Structures to be assembled, and wherein selected connector elements are provided with projecting mounting lugs for receiving and mounting, at spaced intervals, a tubular plastic (typically flexible) track element. Assembly of the basic structure proceeds in accordance with principles of the several Glickman U.S. patents mentioned above, utilizing at the appropriate locations special connectors having projecting rail-mounting lugs. Upon completion of the basic structure, the individual rails 11,12 are quickly and easily applied by either snapping the flexible rail element over the exposed ends of the rail-mounting lugs 35, or by "threading" the rail element onto the lugs in a linear fashion, advancing the end of the rail-forming tube individually over successive mounting lugs. Application of the rails over the mounting lugs 35 is facilitated by the divergent guide flanges 39*a*, which initially help to position the rail elements properly with respect to the mounting lugs and then to wedge open the throat sufficiently to allow the throat to pass over the enlarged head portions 37 of the mounting lugs.

Particularly where the span between structural connectors is fairly long and/or where the vehicle to be supported is heavier than normal, intermediate support of the flexible rail elements can be provided by means of clip-like supports, which can be snapped over elements of the structural framework and adjusted longitudinally therealong to any appropriate position. This can be particularly useful where the track framework is structured for a horizontal curve, for example, because the normal span between structural connectors on the outside of the curve can be substantially greater than on the inside of the curve in such areas.

The structure of the invention, which can employ to advantage substantially continuous, flexible rail elements, enables an endless variety of railed structures to be assembled. Utilizing a kit of multiple loose parts, provided in a variety of strut lengths and connector types, a virtually endless variety of structures may be assembled for the support and guidance of wheeled vehicles along a smoothly contoured guide track arrangement. Both monorail and parallel rail structures are possible using the system of the invention.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A track construction for a toy construction system which comprises (a) at least one section of tubing forming an individual rail element, (b) said section of tubing having a diameter and a length which is a large multiple of such diameter, (c) said section of tubing having outer walls and a hollow interior and having at least longitudinally spaced portions of its outer walls formed with radial opening means to provide access opening means to said hollow interior at least at longitudinally spaced points along the length of said section, (c) a plurality of rail-mounting elements, (d) longitudinally disposed spacing elements for securing a plurality of said rail mounting elements in longitudinally spaced relation, (e) said rail mounting elements each including one or more projecting lugs, each said lug including a projecting portion insertable into said access opening means and thereby into the hollow interior of a section of tubing for securing said section of tubing along a predetermined path formed by said rail mounting elements, and (f) one or more clip-like rail supports removably attachable to said spacing elements and provided with projecting lugs insertable into said access opening means for supporting said tubing at one or more locations intermediate said rail mounting elements.

2. A track construction according to claim 1, wherein (a) said rail mounting elements and said longitudinally disposed spacing elements comprise part of the structural framework of a track structure, and (b) said clip-like rail supports are carried by said structural framework.

3. A track construction according to claim 1, wherein (a) said longitudinally disposed spacing elements comprise elongated rod-like strut elements having opposed pairs of longitudinally extending grooves, (b) said clip-like rail supports each includes a body portion comprised of a pair of spaced-apart opposed gripping arms joined at one end to form an open ended gripping socket, (c) each of said gripping arms having an inwardly extending locking projection located generally directly opposite to a locking projection on the opposed gripping arm, and (d) said gripping arms being resiliently forcible into assembled relation with a cross-wise disposed strut element, into a position in which said locking projections are received in longitudinally extending grooves of said strut element.

4. A track construction according to claim 3, wherein (a) said clip-like support is longitudinally adjustable along said strut element while gripped thereon.

5. A track construction according to claim 1, wherein (a) said longitudinally disposed spacing elements comprise rod-like struts formed with generally cylindrical end portions and with annular grooves in said generally cylindrical end portions adjacent end extremities of said struts to form flanged ends thereof, (b) said rail-mounting elements comprise structural connectors, each having one or more open ended sockets for the lateral snap-in reception of said struts, (c) said sockets being formed by pairs of spaced apart gripping arms provided with axially grooved portions for receiving said generally cylindrical end portions and locking projections for reception in said annular grooves, whereby said struts are locked in position in said sockets while being rotatable therein about central axes of said struts against the friction of said gripping arms, and (d) said clip-like rail supports each having a pair of gripping arms adapted for snap-fit attachment about a strut.

6. A track construction according to claim 5, wherein (a) said struts have longitudinally extending grooves therein engageable with portions of the gripping arms of said clip-like rail supports.

* * * * *